US005512379A

United States Patent [19]

Kawasumi et al.

[11] Patent Number: 5,512,379

[45] Date of Patent: Apr. 30, 1996

[54] COATED PALLADIUM FINE POWDER AND ELECTROCONDUCTIVE PASTE

[75] Inventors: Shinroku Kawasumi; Masatoshi Honma, both of Kanagawa, Japan

[73] Assignee: Kawasumi Laboratories, Inc., Kanagawa, Japan

[21] Appl. No.: 377,129

[22] Filed: Jan. 23, 1995

[30] Foreign Application Priority Data

Jan. 21, 1994 [JP] Japan ..... 6-022215

[51] Int. Cl.[6] ..... B22F 1/00

[52] U.S. Cl. ..... 428/548; 428/559

[58] Field of Search ..... 428/558, 559, 428/548; 427/217, 319, 328; 75/255; 252/512, 519

[56] References Cited

U.S. PATENT DOCUMENTS

| | | | |
|---|---|---|---|
| 4,317,750 | 3/1982 | Provance et al. | 252/519 |
| 4,450,188 | 5/1984 | Kawasumi | 427/217 |
| 4,714,645 | 12/1987 | Kawasumi | 428/209 |
| 4,859,364 | 8/1989 | Yamamoto et al. | 252/512 |
| 5,327,013 | 7/1994 | Moore et al. | 257/772 |
| 5,399,432 | 3/1995 | Schleifstein et al. | 428/403 |

OTHER PUBLICATIONS

Ralls et al., Introduction to Materials Science & Engineering, Wiley & Sons (1976).

*Primary Examiner*—Donald P. Walsh
*Assistant Examiner*—John N. Greaves
*Attorney, Agent, or Firm*—McAulay Fisher Nissen Goldberg & Kiel

[57] ABSTRACT

A coated palladium fine powder comprising palladium particles of a mean particle size in the range of 0.1 to 1.0 μm which are coated with nickel or alloy of nickel with other metal are employable, optionally in combination with palladium particles or palladium-coated ceramic particles of a mean particle size in the range of 0.1 to 1.0 μm, for preparing an electroconductive paste.

8 Claims, 2 Drawing Sheets

COATED PALLADIUM FINE POWDER AND ELECTROCONDUCTIVE PASTE

FIELD OF THE INVENTION

The present invention relates to a coated palladium fine powder and an electroconductive paste containing the coated palladium fine powder.

BACKGROUND OF THE INVENTION

An electrode layer of a built-up condenser (or laminated condenser) or other electronic parts is generally prepared by coating an electroconductive paste which comprises a precious metal powder (such as silver powder, platinum powder, gold powder, or palladium powder) and an organic binder on a ceramic substrate and firing the coated layer. Thus prepared electrode layer is a continuous layer essentially consisting of the precious metal. The continuous layer of precious metal shows low electric resistance and high electroconductivity. Therefore, such precious metal electrode layer has been conventionally employed.

The built-up condenser comprises at least several condenser units (in some cases, condenser units of more than one hundred) in which each condenser unit has an electrode layer formed a ceramic substrate (dielectric substrate). Therefore, each of the substrate and electrode layer for the use of the preparation of a built-up condenser should be as thin as possible. For instance, in a recently prepared built-up condenser comprising condenser units (each being composed of a substrate and an electrode layer) of several tens, one electrode layer generally has a thickness of approximately 1 μm or less.

Various processes for preparing a built-up condenser comprising a large number of condenser units have been known. Most generally employed process comprises laminating several tens of unfired ceramic substrates (i.e., green sheet or raw sheet) coated on their surfaces with an electroconductive paste (which is a mixture of a precious metal powder and a spreading agent containing an organic binder) one on another, and firing the laminated body so that firing of the unfired substrates and burning of the organic binder in the coated layers can be simultaneously done to give the desired electrode layers.

As material of the ceramic substrate of built-up condensers, barium titanate or titanium dioxide is generally employed, because these materials have good dielectric characteristic and physical properties. As material of the electrode, palladium is generally employed because palladium sinters at a temperature almost equivalent to the sintering temperature (approximately 1,200° C.) of barium titanate or titanium dioxide.

Palladium, however, has a drawback in that a palladium powder shows noticeable volume expansion within a short time of period due to rapid oxidation on its surface when it is heated to about 400°–900° C. in air. When such expansion occurs, a composite of several tens of units each of which comprises an electroconductive paste layer comprising a palladium powder and an unfired ceramic substrate is deformed in its thickness direction (i.e., depth direction) in the firing process due to rapid expansion of the electroconductive layer. Thus oxidized palladium powder decomposes to release oxygen to form a palladium electrode layer after firing to 1,000°– 1,200° C. The expansion of the sintered electroconductive paste layer in the thickness direction by the surface oxidation of palladium powder sometimes occurs nonuniformly over the paste layer. Therefore, if the oxidation and expansion of the palladium powder occurs rapidly, structural defects such as delamination and crack are produced in the resulting electrode layer. Further, the thickness sometimes varies locally in the electrode layer. If such structural defects as delamination and crack are produced in the process for preparing a built-up condenser or if the formed electrode of a built-up condenser has nonuniform thickness, the condenser sometimes shows wrong electric characteristics and is failed to requirements. Thus production yield lowers.

Heretofore, the oxidation and expansion of the palladium powder in the electroconductive paste and the structural defects and deformation of the electrode layer caused by the oxidation and expansion are suppressed by controlling the firing conditions (for instance, prolonging the firing period). However, the suppression of the oxidation and expansion by the conventional measures are not sufficient. Moreover, the prolongation of the firing period is disadvantageous in the industrial production.

SUMMARY OF THE INVENTION

The present invention has an object to provide a palladium fine powder which shows high resistance to oxidation in the course of high temperature firing in oxygen-containing conditions such as in air.

The invention also has an object to provide an electroconductive paste which is highly resistant to deformation in the thickness direction in the firing of its coated form.

The invention further has an object to provide a high quality built-up condenser which shows the predetermined electric characteristics with less structural defects and deformation using the above electroconductive paste containing the oxidation-resistant palladium fine powder.

The present invention resides in a coated palladium fine powder which comprises palladium particles of a mean particle size in the range of 0.1 to 1.0 μm which are coated with nickel or alloy of nickel with other metal.

The invention also resides in an electroconductive paste comprising palladium particles of a mean particle size in the range of 0.1 to 1.0 μm, coated palladium particles of a mean particle size in the range of 0.1 to 1.0 μm which are coated with nickel or alloy of nickel with other metal, and a binder.

The invention further resides in an electroconductive paste comprising palladium-coated ceramic particles of a mean particle size in the range of 0.1 to 1.0 μm, coated palladium particles of a mean particle size in the range of 0.1 to 1.0 μm which are coated with nickel or alloy of nickel with other metal, and a binder.

DETAILED DESCRIPTION OF THE INVENTION

Figure 1:
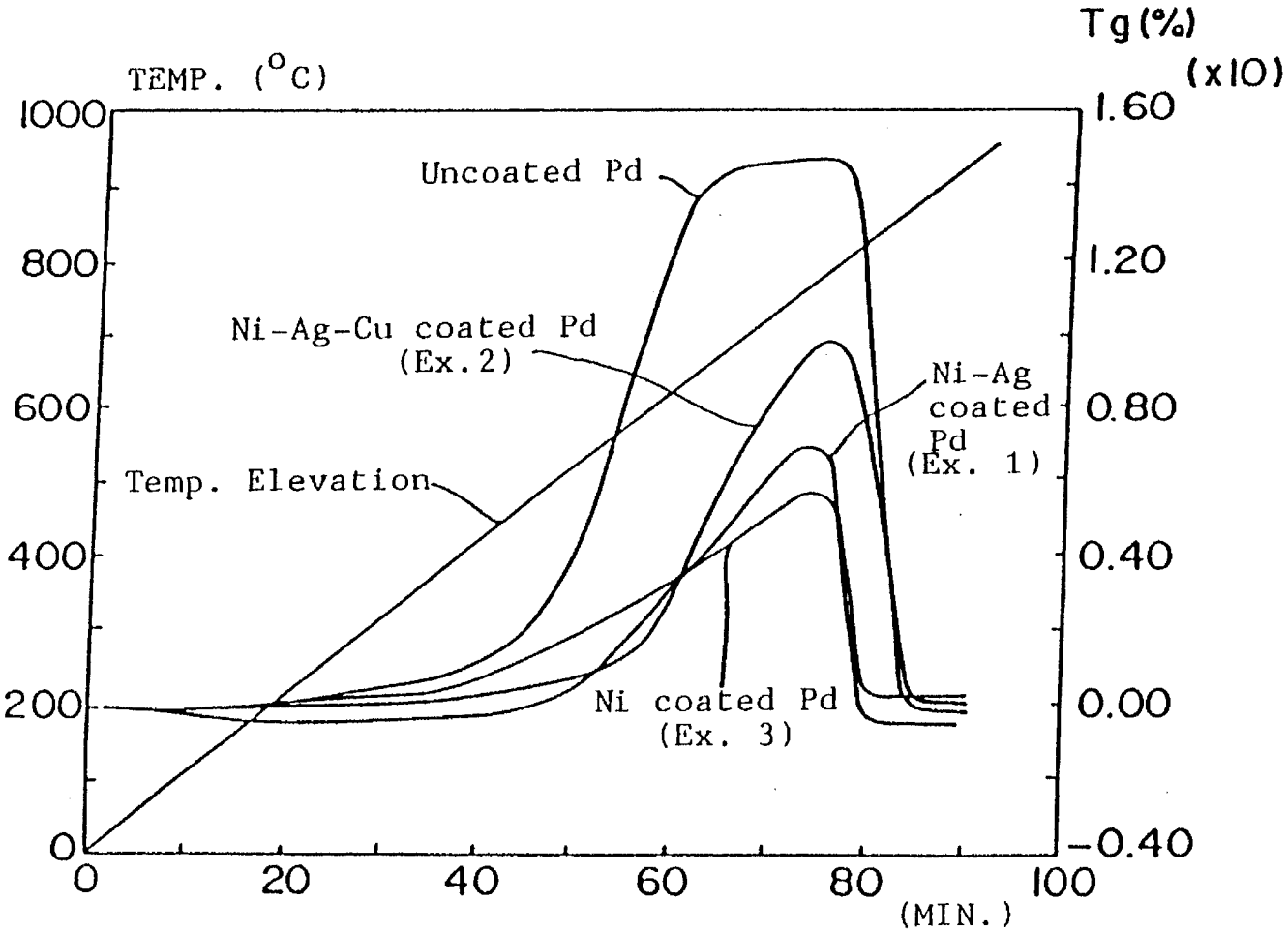
FIG. 1 is a graph which shows an example of antioxidation property of the coated palladium fine powder according to the present invention as well as that of uncoated palladium fine powder.

The coating layer of the coated palladium fine powder preferably comprises nickel only, an alloy of nickel and silver, an alloy of nickel and copper, or an alloy of nickel, silver and alloy, because these show high antioxidation property. However, other metals such as Au, Be, Bi, Cd, Co, Cr, Fe, In, Mg, Mn, Mo, Nb, Pb and combinations of two or more these metals can form an alloy with nickel. These alloys are also utilizable. The alloy of nickel and other metal can be formed in the weight ratio range of 1:9 to 9:1, preferably 1:4 to 4:1. The alloy of nickel, silver and copper is preferably formed in the weight ratio range of 1:0.5:0.5 to 1:4:2 (Ni:Ag:Cu).

The coated palladium fine powder comprising palladium particles of a mean particle size in the range of 0.1 to 1.0 μm which are coated with a thin coating layer of nickel or an alloy of nickel with other metal can be prepared by dispersing a palladium fine powder in an aqueous solution of a nickel complex (for example, ammine complex) or of a mixture of a nickel complex and a complex of other metal (e.g., ammine complex), adding a reducing agent such as hydrazine to the dispersion, and stirring the mixture to deposit on the surface of palladium particle a thin coating layer of nickel or an alloy of nickel and other metal.

The palladium fine powder employed in the invention has a mean particle size of 0.1 to 1.0 μm, preferably 0.2 to 0.9 μm, and more preferably 0.4 to 0.8 μm. The coated palladium fine powder of the invention preferably comprises the palladium core and the coating layer of nickel (Ni) or an alloy of nickel (Ni) and other metal (hereinafter referred to as Me) in the weight ratio of 100:0.2 to 100:10 (Pd:Ni or Pd:Ni+Me). More preferably, the ratio is in the range of 100:0.5 to 100:5.0, and most preferably in the range of 100:1.0 to 100:4.5. Therefore, the coating layer of Ni or the nickel alloy according to the invention is a very thin layer such as a monoatomic layer or a similar thin layer.

The palladium fine powder to be coated with nickel or the nickel alloy in the invention can be a precoated fine powder which is formed by coating a ceramic powder or a base metal powder with a palladium layer.

The above-mentioned palladium coated ceramic powder can be prepared by adding a reducing agent to a dispersion of a ceramic powder in an aqueous palladium salt solution or an aqueous solution of other precious metal salt to form a thin palladium or other precious metal coating over the surface of the ceramic powder; dispersing thus obtained ceramic powder having the thin aqueous metal coating thereon in an aqueous solution of a palladium salt and a water-soluble polymer; and adding to the dispersion a reducing agent to form a palladium-coating layer over the thin precious metal-coated ceramic powder. This process of double coating of a metallic precious metal layer is an improved process derived from a known chemical plating process. In other words, the improved process is based on the known chemical plating process for the preparation of a precious metal coating which comprises adding a reducing agent to a dispersion of ceramic powder in an aqueous precious metal salt solution to reduce the precious metal salt so as to deposit the corresponding precious metal over the ceramic powder. The improvement of this process resides in the formation of a precious metal coating of high purity, namely, with little ceramic material contamination and little exposure of the ceramic surface, which results from the suppression of agglomeration of the ceramic powder or the precious metal-coated powder.

There is no specific limitation with respect to the ceramic material which forms a core of the palladium or precious metal coated ceramic particle. Various known ceramic materials which are generally employed for forming electronic parts are optionally employed. Examples of the known ceramic materials include barium titanate, oxides such as aluminum oxide, titanium dioxide, zirconium oxide and silicon dioxide, powdery piezoelectric or electrostrictive ceramics such as oxides, for instance, $PbTiO_3$, PZT(=Pb $(Zr,Ti)O_3$), PLZT(=(Pb, La) $(Zr,Ti)O_3$) and PMN (=$Pb(Mg_{1/3}Nb_{2/3})$, and metal oxide particles containing these metal oxides.

There is no specific limitation with respect to particle size of the ceramic powder. However, the above process is favorably employable to coat a metallic palladium over a very fine ceramic powder having a particle size of 3 μm or less, particularly 1 μm or less, with high purity. Therefore, the use of such extremely fine ceramic powder is favorable. Moreover, by the use of the above coating process, uniform coating of a more fine ceramic powder such as a powder having a particle size (diameter) of 0.8 μm or less, specifically a powder having a particle size (diameter) of 0.5 μm or less, with high purity can be realized.

The process for the formation of the thin palladium coating over a ceramic powder is described below, in more detail.

First, a primary dispersion is prepared by dispersing a ceramic powder uniformly in an aqueous palladium salt solution or an aqueous solution of other precious metal salt which is formed by dissolving a water-soluble precious metal salt in water. The primary dispersion can be prepared by dissolving a precious metal salt in an aqueous ceramic powder dispersion.

Examples of the water-soluble precious metal salts include salts or complex salts of precious metal such as ammonium tetrachloropalladate, tetraammine palladium dichloride, ammonium tetrochloroplatinate, and ammonium tetraammineplatinum dichloride. The primary dispersion can contain a small amount of other material such as a water-soluble polymer in addition to the water-soluble precious metal salt and the ceramic powder, provided that the amount of the water-soluble polymer should be less than that of a water-soluble polymer to be used in the preparation of a secondary dispersion.

Second, a reducing agent is added to a stirred ceramic dispersion (primary dispersion). The reducing agent may be that generally employed in a chemical plating process. Examples of the known reducing agents include hydrazine, hydrazine hydrochloride, formic acid, formalin, and hypophosphite. The reducing agent is generally added to the primary dispersion in the form of an aqueous solution. Alternatively, the primary dispersion can be added to the aqueous reducing agent solution. By mixing the primary dispersion and an aqueous reducing agent, an extremely thin precious metal coating (monoatomic film or similar film) is formed over the surface of the ceramic particle.

The ceramic powder coated with the extremely thin precious metal layer (namely, primary coated ceramic powder) is then recovered from the dispersion, and then dispersed in an aqueous solution of a palladium salt and a water-soluble polymer to prepare a secondary dispersion. However, the primary coated ceramic powder is not necessarily recovered from the primary dispersion, and the secondary dispersion can be prepared by adding the palladium salt and water-soluble polymer to the primary dispersion containing the primary coated ceramic powder.

The palladium salt (i.e., water-soluble palladium salt) to be used for the formation of the secondary dispersion can be the same as or different from the precious metal salt used for the formation of the primary dispersion.

There is no specific limitation with respect to the water-soluble polymer to be used for the formation of the secondary dispersion. However, water-soluble cellulose derivatives which enable to well disperse the ceramic fine powder in an aqueous medium such as hydroxyethylcellulose, hydroxypropylcellulose, methylcellulose, hydroxyethylmethylcellulose, hydroxypropylmethylcellulose, carboxymethylcellulose can be preferably employed. Alternatively, natural water-soluble polymers such as gelatin and casein and synthetic water-soluble polymers such as polyvinyl alcohol and polyvinylpyrrolidone can be employed.

Subsequently, a reducing agent (preferably in the form of an aqueous reducing agent solution) is added under stirring to the secondary dispersion which comprises the primary coated ceramic powder in an aqueous solution containing the palladium salt and water-soluble polymer. The reducing agent can be the same as that used in the formation of the primary coated ceramic powder. However, other palladium salts also can be employed.

The mixing of the secondary dispersion and the reducing agent (or an aqueous reducing agent solution) results in the formation of a thick palladium coating over the primary coated ceramic powder having the thin precious metal coating.

The ceramic powder on which the double precious metal coatings are formed by the above processes (called secondary coated ceramic powder) is then taken out of the dispersion and dried to give the desired palladium coated ceramic powder.

In the case that the desired palladium coated ceramic powder is prepared by the above process, the ceramic portion (core portion) and the palladium portion (shell portion) preferably are in the weight ratio of 5:95 to 80:20 by weight (ceramic:palladium or combination of palladium and other precious metal), and more preferably are in the weight ratio of 10:90 to 50:50.

The palladium fine powder of the invention which is coated with nickel or an alloy of nickel and other metal per se can be employed as an electroconductive material. However, it is preferred that the nickel or alloy-coated palladium fine powder is employed in combination with a pure palladium fine powder (preferably having a mean particle size of 0.1–1.0 μm) and/or a palladium-coated ceramic powder (preferably having a mean particle size of 0.1–1.0 μm, and preferably the powder prepared in the above double coating process). In these cases, the nickel or nickel alloy-coated palladium fine powder of the invention and the latter pure palladium fine powder and/or palladium-coated ceramic powder are preferably employed in the weight ratio of 9:1 to 1:9, and specifically 8:2 to 2:8.

The electroconductive paste containing the nickel and nickel alloy-coated palladium fine powder of the invention can be prepared by known methods, for instance, by mixing the coated palladium fine powder with appropriate additives (e.g., butylphthalylbutyral), organic binder (e.g., ethylcellulose or polyvinylbutyral), solvent (e.g., terpineol or butanol), etc., to give the desired paste.

The coating of the electroconductive paste on a substrate and the following preparation of the electrode layer is well known. The electroconductive paste of the invention which uses the nickel or nickel alloy-coated palladium fine powder can be processed in the known manner to produce the electrode layer. The production of a built-in condenser using the electroconductive paste of the invention can be also performed in the known manners.

EXAMPLE 1

(1) Preparation of palladium fine powder

In a mixture of 24 mL of a commercially purchased aqueous ammonia (approx. 28% concentration) and 70 mL of water was dissolved 20 g (10 g as Pd) of diamminedichloropalladium $[PdCl_2(NH_3)_2]$. Water was then added to the mixture to adjust the solution volume to 100 mL. To the solution were added 0.6 g of ethylenediamine, 14 mL of aqueous ammonium benzoate solution (10%), and 40 mL of aqueous carboxymethylcellulose solution (1%). The resulting solution was warmed to 30° C., and to this warmed solution was added 15 mL of aqueous hydrazine (20%). The resulting mixture was then stirred at 30°–40° C. for one hour to reduce the palladium salt to precipitate a palladium fine powder. The precipitated powder was collected by filtration, washed and dried to give 10 g of a palladium fine powder (mean particle size: 0.8 μm).

(2) Preparation of Ni-Ag alloy coated palladium fine powder

To the above-obtained palladium fine powder were added aqueous diammine silver chloride $[Ag(NH_3)_2]Cl$ (containing 0.2 g of Ag) and aqueous hexaamminenickel dichloride $[Ni(NH_3)_6]Cl_2$ (containing 0.2 g of Ni). To the resulting mixture was added 20 mL of aqueous hydrazine (10%). The mixture was then heated and stirred for 1.5 hours under keeping the mixture at a temperature of lower than 70° C. to uniformly deposit silver and nickel over the surface of the palladium fine powder by reduction. Thus coated palladium was collected by filtration, washed, and dried to give 10.4 g of a palladium fine powder coated with thin layer of Ni-Ag alloy (weight ratio=1:1, total 0.4 g). The Ni-Ag coated palladium fine powder had a mean particle size of 0.8 μm.

EXAMPLE 2

(1) Preparation of Ni-Ag-Cu alloy coated palladium fine powder

To the palladium fine powder obtained in Example 1-( 1) above were added aqueous diammine silver chloride $[Ag(NH_3)_2]Cl$ (containing 0.2 g of Ag), aqueous hexaamminenickel dichloride $[Ni(NH_3)_6]Cl_2$ (containing 0.1 g of Ni) and aqueous tetraamminecopper dichloride $[Cu(NH_3)_4]Cl_2$ (containing 0.1 g of Cu). To the resulting mixture was added 40 mL of aqueous hydrazine (10%). The mixture was then heated and stirred for 1.5 hours under keeping the mixture at a temperature of lower than 70° C. to uniformly deposit silver, nickel and copper over the surface of the palladium fine powder by reduction. Thus coated palladium was collected by filtration, washed, and dried to give 10.4 g of a palladium fine powder coated with thin layer of Ni-Ag-Cu alloy (weight ratio=1:2:1, total 0.4 g) . The Ni-Ag-Cu coated palladium fine powder had a mean particle size of 0.8 μm.

EXAMPLE 3

(1) Preparation of nickel-coated palladium fine powder

To the palladium fine powder obtained in Example 1-( 1) above was added aqueous hexaamminenickel dichloride $[Ni(NH_3)_6]Cl_2$ (containing 0.4 g of Ni). To the resulting mixture was added 0.2 g of sodium borohydride. The mixture was then heated and stirred for 1.5 hours under keeping the mixture at a temperature of lower than 70° C. to uniformly deposit nickel over the surface of the palladium fine powder by reduction. Thus coated palladium was collected by filtration, washed, and dried to give 10.4 g of a palladium fine powder coated with thin layer of Ni-( 0.4 g) . The Ni-coated palladium fine powder had a mean particle size of 0.8 μm.

EXAMPLE 4

(1) Preparation of Ni-Cu alloy coated palladium fine powder

To the palladium fine powder obtained in Example 1-( 1) above were added aqueous hexaamminenickel dichloride $[Ni(NH_3)_6]Cl_2$ (containing 0.2 g of Ni) and aqueous tetraamminecopper dichloride $[Cu(NH_3)_4]Cl_2$ (containing 0.2 g of Cu). To the resulting mixture was added 40 mL of aqueous hydrazine (10%). The mixture was then heated and stirred for 1.5 hours under keeping the mixture at a temperature of lower than 70° C. to uniformly deposit nickel and copper over the surface of the palladium fine powder by reduction. Thus coated palladium was collected by filtration, washed, and dried to give 10.4 g of a palladium fine powder coated with thin layer of Ni-Cu alloy (weight ratio=1:1, total 0.4 g). The Ni-Cu coated palladium fine powder had a mean particle size of 0.8 μm.

Antioxidation of Coated and Uncoated Palladium Fine Powders

The uncoated palladium powder and Ni-Ag coated palladium powder obtained in Example 1, Ni-Ag-Cu coated palladium powder obtained in Example 2, and Ni-coated palladium powder obtained in Example 3 were evaluated in their antioxidation property by the following method.

The sample powder (95 mg) was placed on a quartz microcell and heated in TG-DTA measuring apparatus (Vacuum Science Co., Ltd.: trade number TGB-7000RH) from room temperature to 950° C. at the temperature increase ratio of 10° C./min. In the course of the increase of the temperature, variation of TG (weight) was detected to check oxidation. The detected results are illustrated in FIG. 1 of the attached drawing.

From the results of FIG. 1, the palladium fine powder coated with nickel or nickel-alloy according to the invention shows oxidation apparently less than oxidation observed in the uncoated palladium fine powder. Particularly, the palladium fine powder coated with nickel alone is highly resistant to oxidation. However, the palladium fine powder coated with nickel alone may have some disadvantageous problem as compared with the palladium fine powder coated with nickel alloy in that the oxidation of the former powder starts at a relatively low temperature.

Preparation of Electroconductive Paste (1) Preparation of electroconductive paste I 100 Weight parts of a mixture of the nickel-alloy coated palladium fine powder of Example 1 or 2 (70 wt. %) and the below-mentioned palladium-coated barium titanate fine powder (30 wt. %), 5 weight parts of ethylcellulose, and 75 weight parts of terpineol were sufficiently kneaded in a three-roll mill to give an electroconductive paste I.

For comparison, a control electroconductive paste I was prepared in the same manner except for using the uncoated palladium fine powder of Example 1 in place of the nickel-alloy coated palladium fine powder.

Preparation of Pd-coated barium titanate fine powder

1) Preparation of primary palladium-coated barium titanate fine powder

To 200 mL of pure water were added 2.0 g of barium titanate fine powder ($BaTiO_2$, mean particle size: 0.2 μm, relative surface area: 12.7 $m^2g$) and 3.2 mL of aqueous ammonium tetrachloropalladate solution (containing 1 g of palladium per 100 mL of water). There was obtained a primary dispersion in which the barium titanate fine powder was dispersed in an aqueous ammonium tetrachloropalladate solution. At room temperature, 1.2 mL of aqueous hydrazine hydrate solution (prepared by diluting 1 mL of 100% hydrazine hydrate with 100 mL of pure water) was added to the primary dispersion under stirring. By the addition of the aqueous hydrazine hydrate solution, a very small amount of metallic palladium was deposited uniformly over the surface of the barium titanate fine powder to give the primarypalladium-coated barium titanate fine powder.

2) Preparation of secondary palladium-coated barium titanate fine powder

The above-obtained primary palladium-coated barium titanate fine powder was recovered, dried and then dispersed uniformly in an aqueous hydroxyethylcellulose solution (0.2 g/500 mL). Subsequently, an aqueous tetraamminepalladium dichloride solution (containing 18.0 g of palladium) was added to the dispersion to give the secondary dispersion. At room temperature, an aqueous hydrazine hydrate solution (containing 5.4 mL of 100% hydrazine hydrate) was gradually added to the secondary dispersion under stirring. By the addition of the aqueous hydrazine hydrate solution, a barium titanate fine powder having black-gray coating layer thereon was precipitated. The precipitated powder was collected by filtration, washed with water, and dried to give a dry fine powder. The dry fine powder (secondary coated powder) was observed by a scanning electron microscope. It is confirmed that the powder is a uniformally distributed powder with little agglomeration.

The secondary coated powder consisted of 90 weight % of palladium metal and 10 weight % of barium titanate.

(2) Preparation of electroconductive paste II

100 Weight parts of a mixture of the nickel or nickel alloy-coated palladium fine powder of Example 1, 2 or 3 (70 wt. %) and the palladium fine powder of Example 1 (30 wt. %), 5 weight parts of ethylcellulose, and 75 weight parts of terpineol were sufficiently kneaded in a three-roll mill to give an electroconductive paste II.

Thermal Expansion of Electroconductive Pastes

Each of the electroconductive paste I (using Ni-Ag coated Pd powder or Ni-Ag-Cu coated Pd powder) or the control electroconductive paste II was coated and dried (at 80° C.) on a square polyacrylic resin substrate (1 cm×1 cm) having a smooth surface. The procedure of the coating and drying was repeated to give a multicoated layer of approx. 350 μm thick. The thick layer was finally dried by heating at 150° C. for 2 hours to prepare a dry electroconductive paste film of approx. 180 μm thick. The obtained electroconductive paste film was peeled from the substrate and cut to give a square sample sheet (approx. 3 mm×1 mm).

Figure 2:
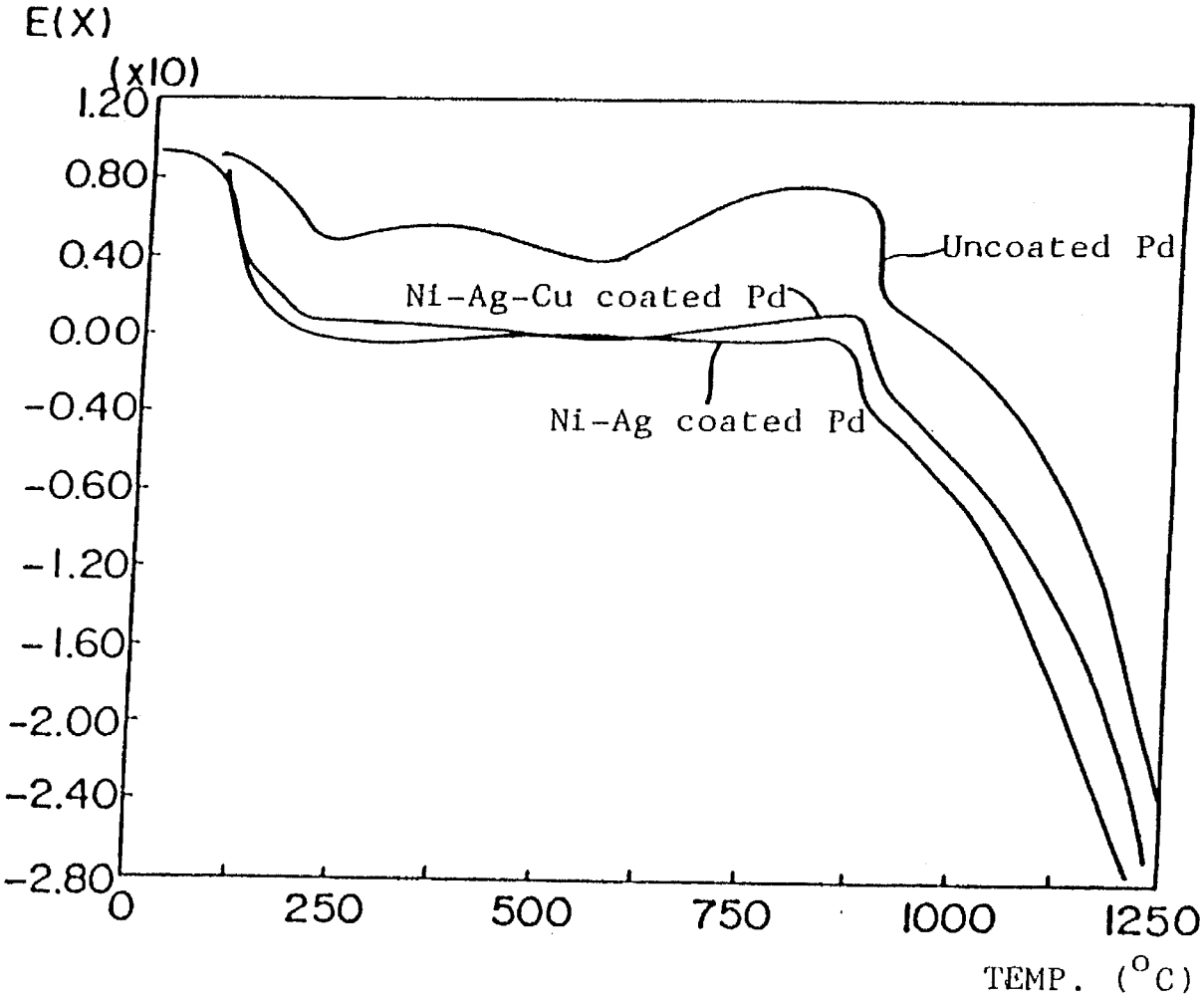
FIG. 2 is a graph which shows an example of thickness variation in the firing process of the electroconductive paste containing the coated palladium fine powder of the invention as well as that of the uncoated palladium fine powder.

The sample was placed on a quartz sample mount (spacer) and heated in TMA measuring apparatus (Vacuum Science Co., Ltd.: trade number DL-7000RH, Y type) from room temperature to 1,250° C. at the temperature increase ratio of 10° C./min. Along the increase of the temperature, TMA (expansion weight) was detected to check variation of the film thickness. The detected results are illustrated in FIG. 2 of the attached drawing. In FIG. 2, "E(x)" means expansion ratio.

From the results of FIG. 2, the electroconductive paste using the palladium fine powder coated with nickel alloy according to the invention shows variation of the film thickness in the firing stage of approx. 250° C. to approx. 850° C. apparently less than the variation observed in the electroconductive paste using the uncoated palladium fine powder. In the firing stage of approx. 250° C. to approx. 850° C., the low boiling organic material of the electroconductive paste was completely evaporated. The decrease of the film thickness after that stage is due to sintering.

We claim:

1. A coated palladium fine powder which comprises palladium particles of a mean particle size in the range of 0.1 to 1.0 μm which are coated with nickel or alloy of nickel with other metal.

2. The coated palladium fine powder of claim 1, wherein the palladium particles are coated with alloy of nickel and silver or alloy of nickel and copper.

3. An electroconductive paste comprising palladium particles of a mean particle size in the range of 0.1 to 1.0 μm, coated palladium particles of a mean particle size in the range of 0.1 to 1.0 μm which are coated with nickel or alloy of nickel with other metal, and a binder.

4. The electroconductive paste of claim 3, wherein the coated palladium particles comprise palladium particles and coating layer of alloy of nickel and silver or alloy of nickel and copper.

5. An electroconductive paste comprising palladium-coated ceramic particles of a mean particle size in the range of 0.1 to 1.0 μm, coated palladium particles of a mean particle size in the range of 0.1 to 1.0 μm which are coated with nickel or alloy of nickel with other metal, and a binder.

6. The electroconductive paste of claim 5, wherein the coated palladium particles comprise palladium particles and coating layer of alloy of nickel and silver or alloy of nickel and copper.

7. The electroconductive paste of claim 1, wherein the palladium particles are coated with the nickel or alloy of nickel with other metal in an amount of 0.2 to 10 weight parts per 100 weight parts of the palladium particles.

8. The electroconductive paste of claim 5, wherein the palladium-coated ceramic particles are coated with the nickel or alloy of nickel with other metal in an amount of 0.2 to 10 weight parts per 100 weight parts of the palladium-coated ceramic particles.

* * * * *